US007399261B2

(12) United States Patent
Boldrini et al.

(10) Patent No.: US 7,399,261 B2
(45) Date of Patent: Jul. 15, 2008

(54) SYSTEM FOR FORMING CONTAINERS

(75) Inventors: Fulvio Boldrini, Ferrara (IT); Roberto Ghiotti, Pietro (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/521,096

(22) PCT Filed: Jul. 14, 2003

(86) PCT No.: PCT/IB03/03177

§ 371 (c)(1),
(2), (4) Date: Jan. 13, 2005

(87) PCT Pub. No.: WO2004/011239

PCT Pub. Date: Feb. 5, 2004

(65) Prior Publication Data

US 2005/0250633 A1 Nov. 10, 2005

(30) Foreign Application Priority Data

Jul. 25, 2002 (IT) ..... BO2002A0485

(51) Int. Cl.
*B31B 1/34* (2006.01)

(52) U.S. Cl. ..... 493/165; 493/162; 493/164; 493/175; 493/181

(58) Field of Classification Search ..... 493/62, 493/68–72, 69, 59, 133, 155–157, 162, 164–165, 493/175, 181; 53/563
See application file for complete search history.

(56) References Cited

U.S. PATENT DOCUMENTS 3,187,646 A * 6/1965 Monroe et al. ..... 493/164
4,493,687 A * 1/1985 Bernle ..... 493/310
4,530,692 A 7/1985 Williams
4,573,957 A * 3/1986 Billberg ..... 493/309

(Continued)

FOREIGN PATENT DOCUMENTS

CH 413339 5/1966

(Continued)

OTHER PUBLICATIONS

International Search Report dated Jan. 29, 2004.

*Primary Examiner*—Hemant M. Desai
(74) *Attorney, Agent, or Firm*—Timothy J. Klima

(57) ABSTRACT

Containers (2) for food products are manufactured employing a system that includes a feed station (4) supplying a succession of tubular elements (2*a*), and a heat sealer (10) positioned to close and secure a first open end (2*b*) of each tubular element (2*a*) that coincides with the base of the container. The sealing operation occurs at a station associated with a conveyor (3) consisting in a wheel (11) rotatable in a feed direction (B) along a path (P) passing both through the feed station (4) and through the station occupied by the heat sealer (10). The tubular elements (2*a*) are carried by radial elements (13) of the wheel (11) such as can be indexed between a first operating position, where the tubular elements (2*a*) are taken up from the feed station (4), and a second operating position in which the open end (2*b*) is offered to the heat sealer (10).

10 Claims, 5 Drawing Sheets

U.S. PATENT DOCUMENTS

| | | | | |
|---|---|---|---|---|
| 4,604,850 | A * | 8/1986 | Reil | 53/423 |
| 4,713,048 | A * | 12/1987 | Reil et al. | 493/74 |
| 5,033,975 | A * | 7/1991 | Traegaardh | 493/310 |
| 5,069,021 | A | 12/1991 | Reil et al. | |
| 5,143,281 | A * | 9/1992 | Mainz et al. | 229/132 |
| 6,387,028 | B1 * | 5/2002 | Nishio et al. | 493/165 |
| 6,514,185 | B1 | 2/2003 | Knuppertz et al. | |

FOREIGN PATENT DOCUMENTS

| | | |
|---|---|---|
| DE | 19711799 | 10/1998 |
| JP | 63-82736 | 4/1988 |

* cited by examiner

SYSTEM FOR FORMING CONTAINERS

This application is the National Phase of International Application PCT/IB2003/03177 filed Jul. 14, 2003 which designated the U.S. and that International Application was published under PCT Article 21(2) in English.

TECHNICAL FIELD

The present invention relates to a system for forming containers, in particular containers for food products.

More precisely, albeit with no limitation implied, the present invention is applicable to the art field of systems used in manufacturing containers of any given kind for food products, and in particular, containers designed for packaging liquid products, typically milk, fruit juices, yoghurt, mineral water and other such substances.

BACKGROUND ART

It is common practice for liquid products of the type in question to be bottled in containers of which the structure can be manufactured from multilayer or treated paper material, such as paperboard or cardboard coated with one or more layers of food-safe material suitable for liquids.

The containers in question are fashioned in most cases from flat blanks cut generally from a roll of material and bent as necessary along strategically placed crease lines to a shape suitable for holding a liquid product.

As a rule, such containers present a tubular configuration of substantially square cross section.

The containers are manufactured using conventional machines such as will bend the flat blank to create a tubular element presenting an open top end and an open bottom end.

Initially, the containers are advanced through various processing stations equipped with mechanical arms by which the edges of the open bottom end of the tubular element are bent and folded so as to enclose the end. In practice, the arms are arranged in sets, each designed to perform a particular operation on the edges of the container. The arms are also equipped with heat seal plates positioned to engage selected points of the resulting end folds and thus render the closure permanent.

The partially enclosed container is then placed in a filling station, where a liquid product will be directed in through the open top end. Thereafter, the top end is closed by bending the relative edges and securing the folds in same way as for the bottom end already described above.

Machines of the type in question present a notable drawback deriving from the excessive bulkiness of the components by which the folds of the container are bent and secured. In effect, the containers need to be transferred from one station to another by a conveyor, consisting generally in a belt passing through the various forming stations. This means that the belt must necessarily be of a certain length in order to pass through all the different stations, and consequently that considerable space is taken up by the system.

Moreover, the mechanical arms are particularly cumbersome precisely by reason of the numerous movements they have to complete, and an appreciable amount of operating space is therefore required.

The object of the present invention, accordingly, is to provide a system for forming containers, in particular containers for food products, featuring compact dimensions and occupying minimal space.

More exactly, it is an object of the invention to provide a system for forming containers, in particular containers for food products, such as will allow of optimizing the spaces utilized in closing and sealing the open end of the container.

A further object of the present invention is to minimize the space needed in order to accommodate the mechanism by which the containers are conveyed.

DISCLOSURE OF THE INVENTION

The stated objects and others besides, which will emerge more clearly from the following specification, are substantially realized in a system for forming containers, in particular containers for food products, of which the characterizing features are as recited in claim 1 appended.

BRIEF DESCRIPTION OF DRAWINGS

The invention will now be described in detail, by way of example, with the aid of the accompanying drawings, in which.

DETAILED DESCRIPTION OF THE INVENTION

With reference to the drawings, 1 denotes a system according to the present invention for forming containers 2, in its entirety.

Figure 1:
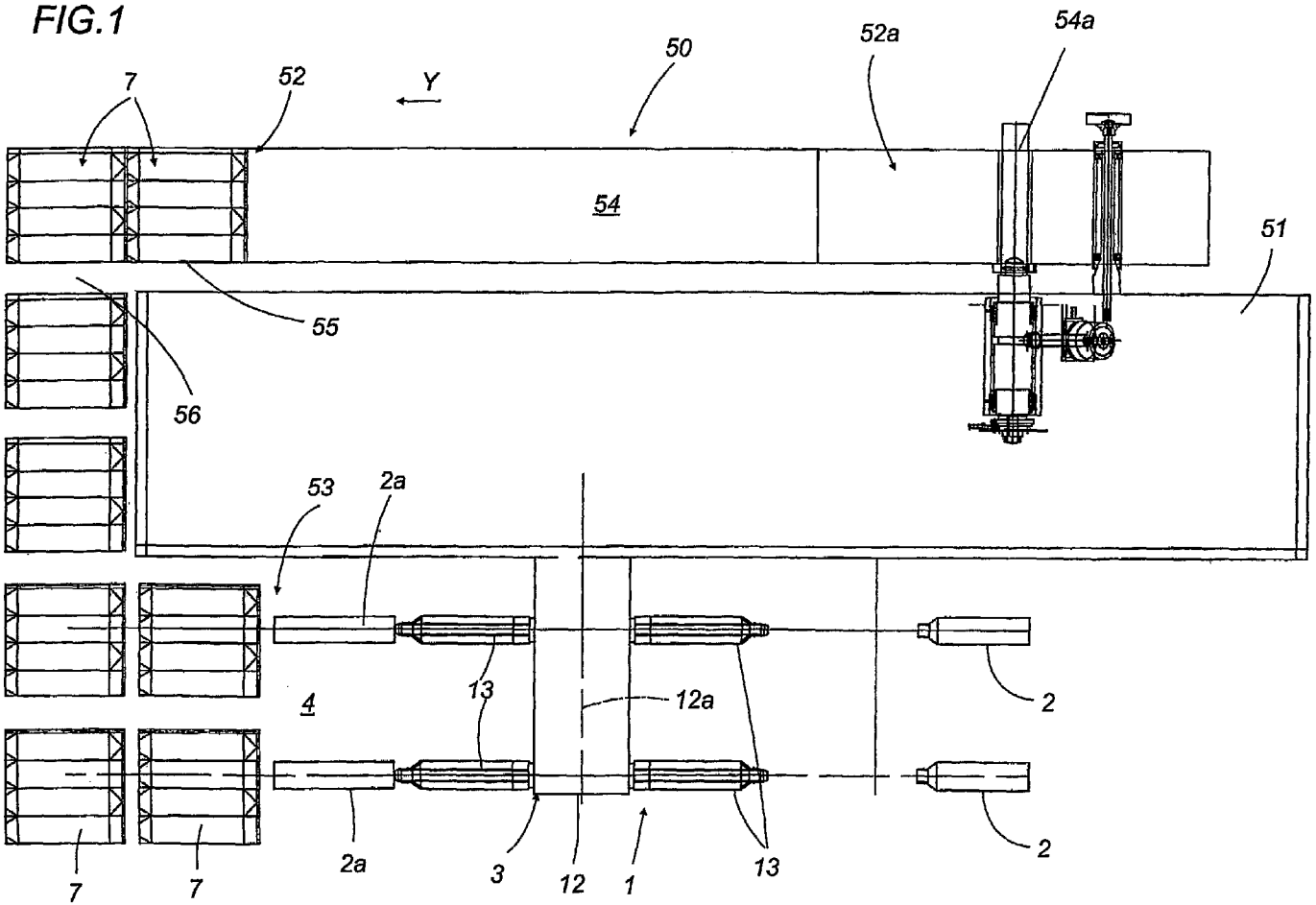
FIG. 1 is a plan view of a system for forming containers.

As indicated in FIG. 1, the system 1 comprises a supporting structure 51 and, associated with this same structure, a forming sector 52 serving to prepare at least one blank 7 from which to fashion a relative container 2, also a shaping sector 53 operating downstream of the forming sector 52, of which the function is to fold the single blanks 7 emerging from the forming sector and establish the shape of the respective folded containers 2 by means of a fixing operation.

In particular, the forming sector 52 comprises a feed station 52*a* by which a continuous strip 54 of forming material suitable for preserving liquid food products is directed along a predetermined feed path denoted Y. The aforementioned continuous strip 54 of forming material is preferably carried by and decoilable from a reel 54*a* rotatable about a relative longitudinal axis X.

The forming material will consist preferably of a multilayer or treated paper material, such as paperboard or cardboard coated with an impermeable and antiseptic film.

The feed station 52*a* also comprises a plurality of guide elements, consisting preferably in rollers, serving to establish a first leg of the feed path followed by the forming material that extends externally of the supporting structure 51 of the system 1 along a direction substantially parallel to the longitudinal dimension of the selfsame supporting structure.

The system 1 can be equipped with a numbering device serving to mark consecutive portions of the forming material coinciding with the single blanks 7. The numbering device operates between successive guide elements of the feed station 52*a* in such a way as to mark the forming material at a stage along the feed path where the strip extends substantially in a horizontal plane.

The forming sector 53 includes a scoring station 55 positioned downstream of the feed station 52, by which each portion of the forming material destined to provide a relative blank 7 is impressed with at least one crease line. In a preferred embodiment, the scoring station 55 is designed to generate a plurality of crease lines, in a single operation, by which the shape of the container 2 being manufactured is marked out on the flat surface of the forming material.

The scoring station 55 comprises at least one press presenting mutually opposed dies offered to the two faces of the forming material. In operation, the press will alternate between an idle position in which the two dies are distanced from the forming material interposed between them, and an operating position in which they are brought together forcibly against the forming material in such a way as to generate the aforementioned crease lines.

The forming sector 53 also comprises a cutting station 56 operating downstream of the scoring station 55, by which the creased forming material is taken up from this same station and divided into successive discrete pieces each constituting a respective blank 7. The cutting station 56 comprises at least one blade positioned to operate in close proximity to the scoring station 55 so that the forming material can be cut immediately adjacent to the press. In operation, like the press, the blade alternates between an idle position distanced from the forming material, and an operating position of engagement with the selfsame material, in which the strip is cut transversely. To advantage, the blade can be timed to alternate between the idle position and the operating position synchronously with the movement of the press of the scoring station 55 between the idle position and the operating position, so that the press and the blade are made to engage the forming material simultaneously.

Thereafter, the creased and cut blank 7 passes to the shaping sector 53.

The system 1 also comprises a mechanism 3 by means of which to convey a plurality of tubular elements 2*a* constituting the containers 2.

More exactly, the tubular elements 2*a* are advanced by way of a feed station 4 toward the conveying mechanism 3, ordered in single file. The tubular elements 2*a* are prepared by a forming device 5 coinciding with and operating at the feed station 4, as illustrated to advantage in FIG. 4.

Figure 4:
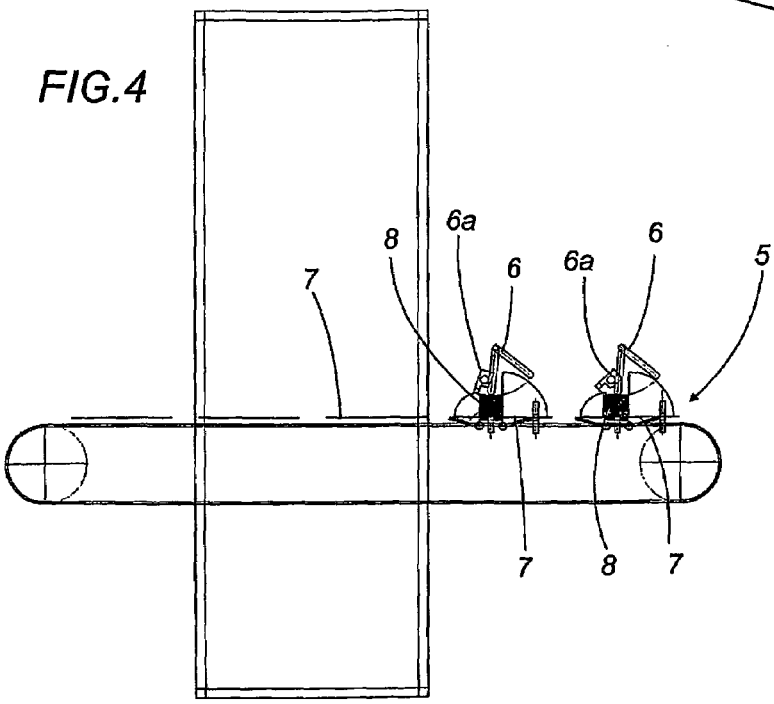
FIG. 4 shows a constructional detail of FIG. 2*a*, viewed in a side elevation.

In greater detail, and referring still to FIG. 4, the forming device 5 presents a gripper element 6 such as will bend the blank 7 of multilayer or treated paper material, typically paperboard or cardboard coated with one of more layers of food-safe material suitable for liquid products. The blank is bent by the gripper element 6 around a former 8 of shape corresponding to the shape of the tubular element 2*a*, in such a way that one longitudinal edge of the selfsame blank 7 will overlap the other.

The forming device 5 also presents a sealer 6*a* serving to join the longitudinal edges and create the tubular element 2*a*, also a feed mechanism 9 by which the tubular element 2*a* is caused to advance along the a radial infeed direction A toward the conveying mechanism 3. The use of the term "sealing" in the course of the specification is intended to indicate any one of several comparable methods, which include heat-sealing, and ultrasound or induction welding. Similarly, the term "sealer" can be taken to signify any given heat-seal or induction or ultrasound welding instrument.

The system could also operate utilizing blanks 7 supplied to the feed station in a precreased tubular configuration, collapsed in such a way as to present an essentially flat rhomboidal cross section.

In this situation, the system 1 could utilize a forming device 5 of conventional embodiment embraced by the prior art, comprising a gripper element 6 that can be offered to the opposite edges of the precreased tubular blank 7 in such a way as to apply a compressive force and thus cause the flattened profile to expand to a substantially square profile when viewed in section. The operation of erecting flat glued tubular blanks in this fashion will be familiar to a person skilled in the art.

The conveying mechanism 3 is disposed facing the feed station 4 and capable of movement between a first operating position in which it takes up the tubular element 2*a* from the feed station 4, and a second operating position in which the tubular elements 2*a* are subjected to the action of respective sealing means 10.

More exactly, the conveying mechanism 3 comprises at least one wheel 11 rotatable in a first feed direction B along a circular sealing path P passing through the feed station 4 and the sealing means 10.

The wheel 11 is composed of a central hub 12 rotatable about a respective axis 12*a*, and a plurality of supporting elements 13 serving to carry the tubular elements 2*a*. The supporting elements 13 project radially from the hub 12, each presenting a first end 13*a* anchored to the selfsame hub 12, and a second end 13*b*, opposite to the first, which appears substantially cylindrical in shape and smaller in section than the remainder of the element 13.

To advantage, as indicated in FIG. 1, the system comprises two wheels 11 disposed one alongside the other, each presenting a relative set of supporting elements 13 arranged around the respective hub 12.

In detail, each supporting element 13 presents a substantially parallelepiped geometry complementing the internal shape of the tubular element 2*a*. In the example of the drawings, the tubular element 2*a* is substantially parallelepiped in appearance and of square cross section. Consequently, the supporting element 13 will present a square parallelepiped shape identical to that of the tubular element 2*a*.

Accordingly, each tubular element 2*a* can be fitted over a respective supporting element 13 in such a way that the respective first open end 2*b* of the selfsame element 2*a* is positioned to coincide with the second end 13*b* of the element 13.

The aforementioned sealing means 10 are positioned along the circular sealing path P, and in particular downstream of the feed station 4 relative to the feed direction B, in such a way as to interact with and close the first open end 2*b* of each successive tubular element 2*a*.

In effect, the sealing means 10 of each wheel 11 consist in a first joining head 10*a* able to interact with the end 2*b* of each tubular element 2*a*, and as a result to unite two mutually opposed sides 14 of the tubular element 2*a* coinciding with the selfsame first open end 2*b*.

Figure 3A:
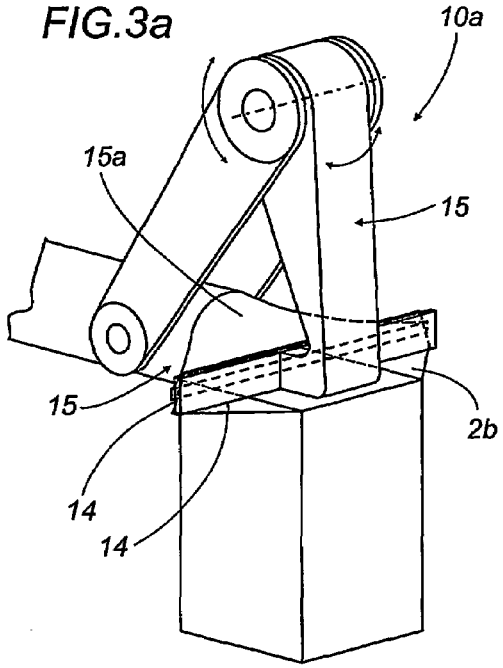
FIGS. 3*a* to 3*e* are perspective illustrations showing a sequence of steps implemented in forming the container.

In greater detail, the first joining head 10*a* comprises two folder elements 15 that can be offered to the corresponding sides 14 in such a way as to draw together and match the respective top edges 14*a* (FIG. 3*a*), also a sealer 15*a* of conventional type, not described further, operating on the two edges 14*a* in such a manner as to secure them one to another.

The sealing means 10 also comprise a press 16 located downstream of the first joining head 10*a*, considered in relation to the feed direction B. The press 16 operates on the two joined sides 14 in such a way as to force them toward the central hub 12 (FIG. 3*c*), generating a base surface 17 of the tubular element 2*a*. The base surface 17 extends flat and substantially transverse to the longitudinal dimension of the tubular element 2*a*, and presents two opposite end folds 18 projecting laterally beyond the relative side walls of the tubular element 2*a*.

Also extending beneath the press 16 are two restraints 19 against which the press 16 is designed to register during the forcing stroke.

More exactly, the restraints 19 are positioned in such a way that the supporting elements 13 are insertable between them, so that whenever a single element 13 carrying a tubular element 2*a* approaches the press 16, the end folds 18 of the joined sides 14 will locate against the restraints 19. Similarly, and in accordance with the second embodiment (illustrated in FIG. 2*b*), the system could also be equipped with two sealers 19*a* positioned along the restraints 19 in such a way as to engage a corresponding seal line 18*a* presented by each end fold 18 (FIGS. 3*b* and 3*c*).

The sealing means 10 also comprise folding means, embodied preferably as a fixed guide 20 positioned along the sealing path P and beyond the press 16, considered in the feed direction B.

The guide 20 is positioned in such a way that the aforementioned end folds 18 will be engaged and bent inwards over the respective sides 14.

Figure 3B:
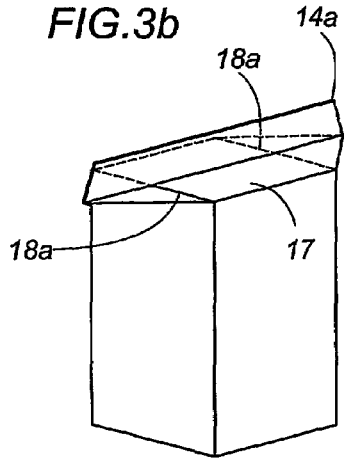
Figure 3C:
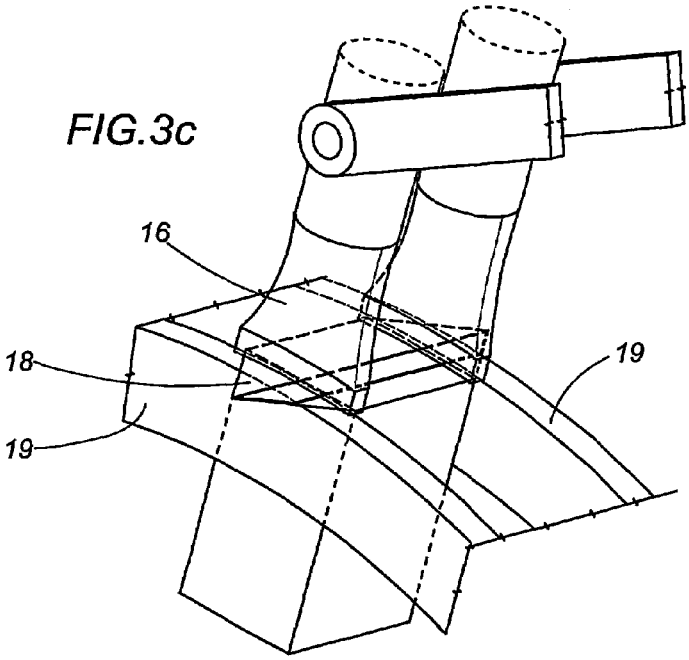
Figure 3D:
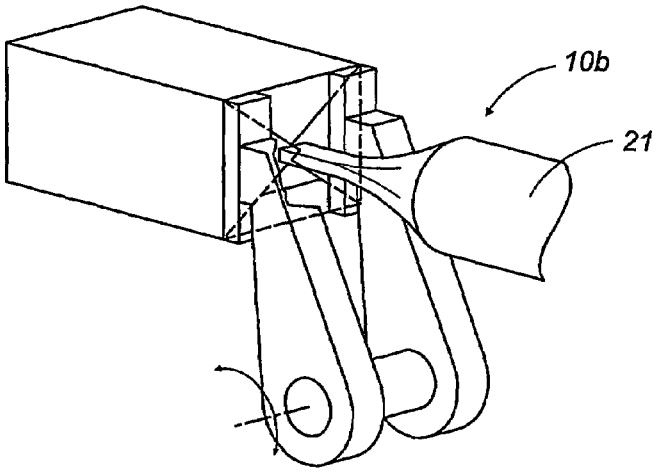
Figure 3E:
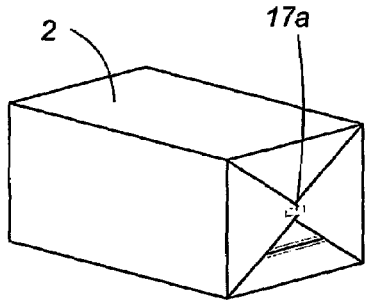

Once folded, the ends 18 will be engaged by a second joining head 10*b* (FIG. 3*d*) and flattened against the base surface 17 to complete the bottom end face of the container (FIG. 3*e*).

In particular, the second joining head 10*b* includes an arm 21 capable of vertical movement and offered to the flattened end folds 18 at a central point 17*a* on the base surface 17.

Figure 2A:
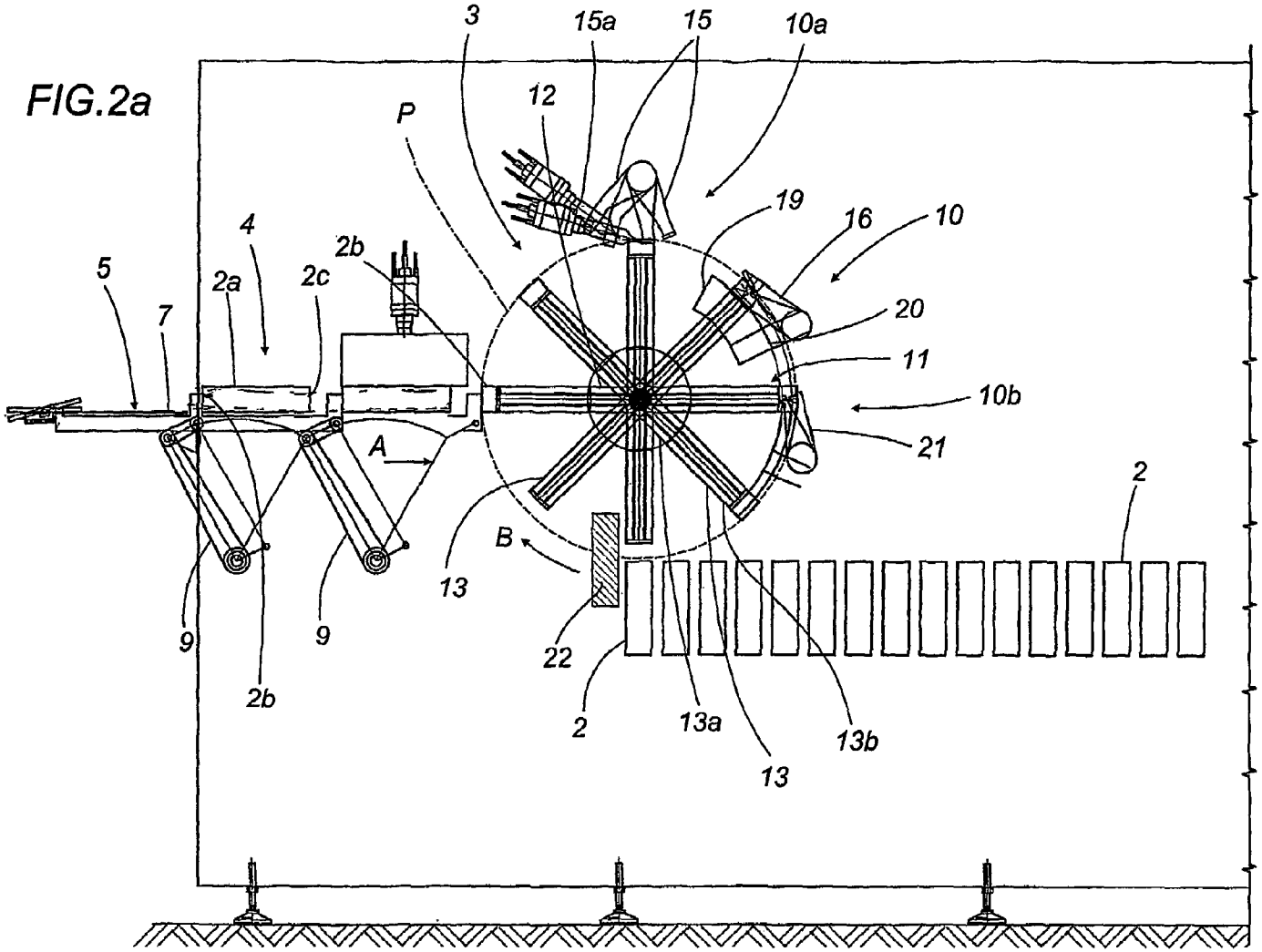
FIG. 2*a* shows a detail of the system for forming containers according to the present invention, viewed in a side elevation.

In the case of the first example illustrated in FIG. 2*a*, the end folds 18 are dabbed with glue at a point near the press 16, by applicator means of conventional type. In this situation, the function of the arm 21 is to pin the two end folds 18 together so that they are bonded by the glue. In the second example of FIGS. 2*b* and 3*d*, the arm 31 can consist in a sealer of the type mentioned above, such as will fuse the end folds 18 directly together.

Figure 2B:
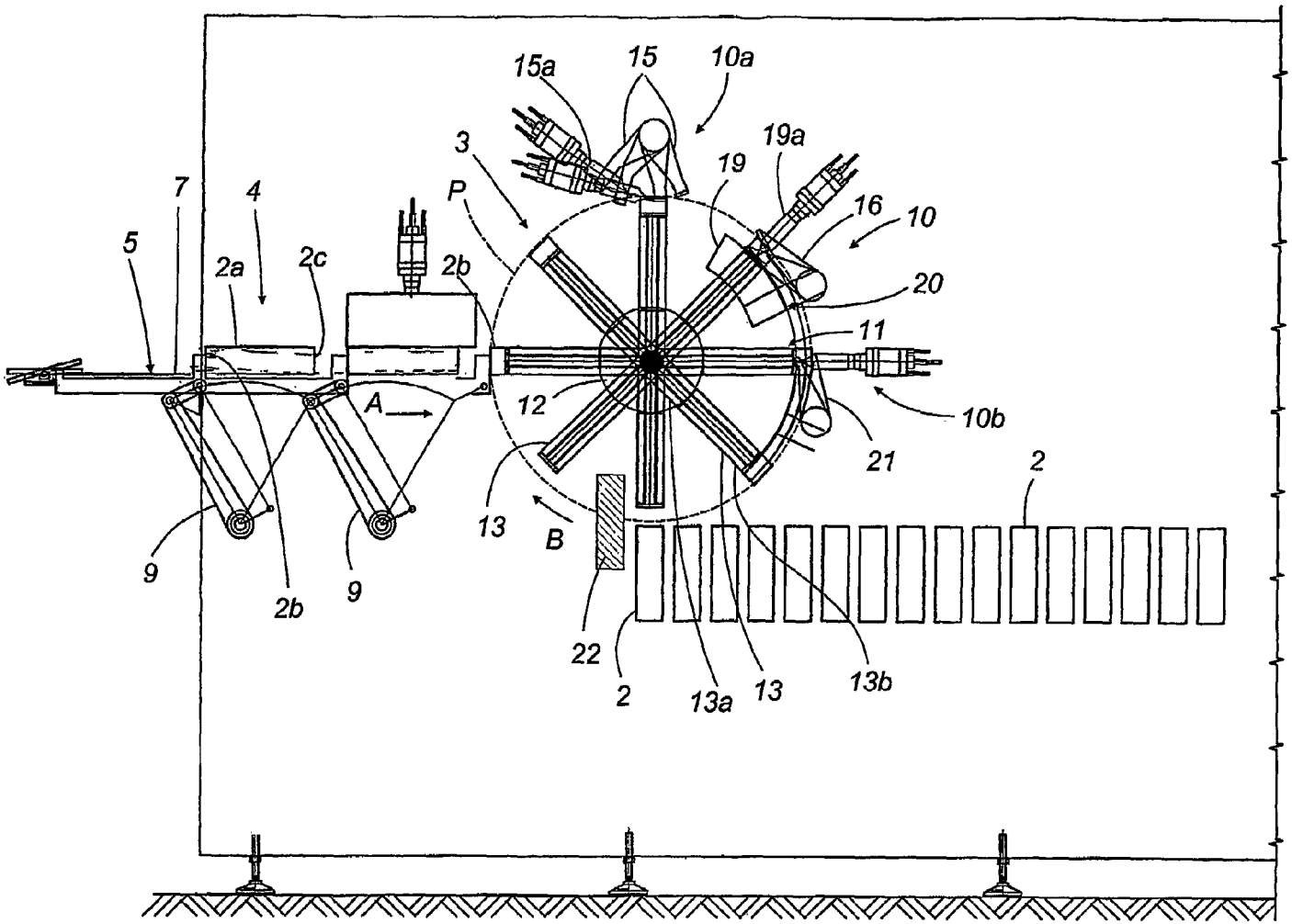
FIG. 2*b* shows a detail of the system for forming containers, illustrated in an alternative second embodiment and viewed in a side elevation.

As illustrated schematically in FIG. 2*a* and 2*b*, the system further comprises an outfeed device 22 operating downstream of the sealing means 10, considered in relation to the feed direction B, by which the containers 2 are taken up from the conveying mechanism 3 and directed toward successive finishing stations that do not directly constitute the subject matter of the present invention and therefore are not described further.

The operation of the system 1, described thus far essentially in structural terms, is as follows.

The tubular elements 2*a* pass along the infeed direction A (FIG. 2) and are taken up by the conveying mechanism 3. More exactly, the tubular element 2*a* are taken up onto the wheel 11 in such a way that each supporting element 13 is ensheathed by a respective tubular element 2*a*. It will be observed that the motion of the wheel 11 is not continuous; rather, the hub 12 is indexed in such a way that the supporting elements 13 are brought into alignment with the feed station 4 and the sealing means 10 at each step.

Each tubular element 2*a* is thus positioned on the relative supporting element 13 with the first open end 2*b* positioned at the second end 13*b* of the selfsame element 13.

The tubular element 2*a* is now advanced along the sealing path P toward the first joining head 10*a*.

The sides 14 of the open end 2*b* are drawn together by the first joining head 10*a* and the respective top edges 14*a* thus united, whereupon the sealer 15*a* passes along the edges 14*a* to seal them one to the other.

Thereafter, the press 16 will flatten the sides 14 against the supporting element 13 to establish the base surface 17 (FIG. 3*b*), as a result of which the selfsame sides 14 are flattened partly against the restraints 19 to form the projecting end folds 18.

To advantage, in the case of the second embodiment shown in FIG. 2*b*, the sealers 19*a* operate along the seal lines 18*a* delimiting the end folds 18, thereby joining the two thicknesses of material and creating a base surface 17 of substantially square outline.

The tubular elements 2*a* formed in this manner are advanced subsequently through the fixed guide 20, which will bend the end folds 18 inward and over the joined sides 14. Finally, the tubular element 2*a* encounters the second joining head 10*b*, whereupon the arm 21 will engage the end folds 18 at the central portion 17*a* of the base surface 17 to seal or glue the folds 18, as described previously, and complete the closure of the container 2 at the bottom end 2*b*.

The container 2 is now conveyed to the outfeed device 22, where it is removed from the supporting element 13 and advanced toward further finishing stations.

The problems associated with the prior art are overcome in accordance with the present invention, and the stated objects duly realized.

First and foremost, by dispensing with long and cumbersome conveyors, the system 1 can be made compact and suitable for inclusion in any given plant set up to manufacture containers for food and similar products. This is an advantage attributable to the distinctive structure of the wheel 11, by which the tubular elements are carried along a circular path P.

Consequently, the elements utilized in forming the tubular element 2*a* can likewise be organized to best advantage and rendered compact in terms of the space required, being arranged along a circular path P rather than a rectilinear path.

Finally, the fact that the system is connected to a supply reel 54*a* means that the container 2 can be formed directly by a station coinciding with the station where the blank is prepared.

The invention claimed is:

1. A system, for forming containers for food products, comprising:

a first feed station by which a continuous strip of a forming material is directed along a predetermined feed path;

a main reel rotatable about a relative longitudinal axis, from which the strip is decoilable along the feed path;

a circular conveying mechanism;

a second feed station supplying a single file of tubular elements generated from the strip along a respective feeding direction on to the circular conveying mechanism;

sealing means, positioned along a path of said circular conveying mechanism operating on a first open end of each tubular element in such a way as to enclose the first end;

a feed mechanism transporting the tubular elements to said circular conveying mechanism along a respective transportation direction;

said circular conveying mechanism comprising at least one wheel rotatable around an axis between a first position of reception of the tubular elements and a second position of alignment of the tubular elements with the sealing means, said axis being perpendicular to the feeding direction and to the transportation direction of the tubular elements in the proximity of the wheel, said feeding direction being parallel to the transportation direction.

2. The system as in claim 1, wherein the wheel comprises a central hub rotatable about said axis, also a plurality of supporting elements projecting radially from the hub and serving to carry the tubular elements, of which the supporting elements each present a first end anchored to the hub and a second end remote from the first end.

3. The system as in claim 2, wherein each supporting element of the wheel presents a substantially parallelepiped shape matched to the internal geometry of the tubular element, in such a way that each tubular element can be fitted over a respective supporting element with the relative first open end positioned at the second end of the supporting element.

4. The system as in claim 2, wherein the sealing means comprise: a first joining head positioned to interact with the first open end of each tubular element and serving to unite two opposite sides of the tubular element coinciding with the selfsame first open end; a press operating downstream of the first joining head, relative to the feed direction, by which the joined sides are engaged and directed forcibly toward the hub in such a way as to establish a substantially flat base surface of the tubular element disposed transversely to the longitudinal dimension of the selfsame element and presenting two end folds projecting laterally from relative opposite side walls of the tubular element; a fixed fold guide positioned along a sealing path and downstream of the press, relative to the feed direction, by which the end folds are engaged, bent toward one another and flattened over the joined sides; and a second joining head positioned to interact with and unite the two end folds, thereby completing the closure at the relative end of the container.

5. The system as in claim 4, wherein the first joining head comprises two folder elements by which the corresponding sides of the open end are drawn together and the respective top edges of the sides matched one to another; also a sealer operating on the two edges in such a way as to secure the selfsame edges one to another.

6. The system as in claim 4, further comprising two restraints positioned in alignment with the press, between which an advancing supporting element is insertable in such a way that each end fold will locate against a respective restraint under the action of the press.

7. The system as in claim 6, further comprising two sealers, each positioned in alignment with a respective restraint and serving to seal the end folds.

8. The system as in claim 4, wherein the second joining head comprises an arm capable of vertical movement and offered to the flattened end folds at a central point on the base surface.

9. The system as in claim 1, wherein the tubular elements are prepared by a forming device positioned to coincide with the second feed station and comprising: a gripper element for bending a blank around a former of shape corresponding to the shape of the tubular element in such a way that one longitudinal edge of the blank is made to overlap the other; and a feed mechanism by which the tubular element is advanced along a radial infeed direction toward the conveying mechanism.

10. The system as in claim 1, wherein the tubular elements are prepared by a forming device positioned to coincide with the second feed station, comprising a gripper element to engage the opposite edges of a precreased blank presenting a tubular structure and a substantially flat rhomboidal profile when viewed in section, and thereupon apply a compressive force to the opposite edges such as will cause the flattened profile of the blank to expand to a substantially square profile when viewed in section.

* * * * *